United States Patent [19]

Klett

[11] 4,435,698

[45] Mar. 6, 1984

[54] CIRCUIT ARRANGEMENT FOR THE TRANSMISSION OF MEASUREMENTS TO A CENTRAL, ESPECIALLY IN A FIRE ALARM SYSTEM

[75] Inventor: Werner Klett, Ehrenkirchen, Fed. Rep. of Germany

[73] Assignee: Hekatron GmbH, Sulzburg, Fed. Rep. of Germany

[21] Appl. No.: 263,258

[22] Filed: May 13, 1981

[30] Foreign Application Priority Data

Jun. 11, 1980 [DE] Fed. Rep. of Germany ..... 3021920

[51] Int. Cl.[3] ..... G08B 29/00; G08B 17/06

[52] U.S. Cl. ..... 340/512; 340/533; 340/870.17; 340/870.19

[58] Field of Search ..... 340/512, 533, 538, 870.19, 340/870.09, 870.16, 870.17

[56] References Cited

U.S. PATENT DOCUMENTS 3,426,348 2/1969 Sadler ..... 340/512
3,553,730 1/1971 Kaplin et al. ..... 340/512
3,665,461 5/1972 Gnägi et al. ..... 340/512
3,778,796 12/1973 Honda ..... 340/533
4,247,848 1/1981 Kitta et al. ..... 340/512

*Primary Examiner*—Glen R. Swann, III
*Attorney, Agent, or Firm*—George E. Kersey

[57] ABSTRACT

Several arrangement in which several measurement sources (fire alarms) are connected in parallel to a two-wire line. The supply voltage for the measurement sources is simultaneously fed through this line. Here, a measurement is formed by switching a measurement shunt circuit into the two-wire line, to generate measurement pulses, where the switch-in process is controlled by a local pulse generator. Each measurement source is provided with a pulse generator, and all these pulse generators operate at frequencies of the same order of magnitude. A monitoring circuit, at the far end of the two-wire line, is switched through by a pulse generator whose frequency is significantly lower. The pulse duration of the monitoring pulses is no longer than the pulse pauses of the measurement pulses.

8 Claims, 6 Drawing Figures

CIRCUIT ARRANGEMENT FOR THE TRANSMISSION OF MEASUREMENTS TO A CENTRAL, ESPECIALLY IN A FIRE ALARM SYSTEM

BACKGROUND OF THE INVENTION

The invention concerns a circuit arrangement for transmitting measured values to a central, especially in a fire alarm system. Here, several sources of measurements (fire alarms) lie in parallel on a two-wire line, through which the supply voltage for the source of the measurements is fed at the same time. In this way, a measurement is formed by switching in a measurement shunt to the two-wire line to generate measurement pulses, where said switch-in process is controlled by a local pulse generator.

Such a circuit is known from the West German Offenlegungsschrift No. 27 01 184. This circuit involves a transmission of measurements from a single measurement source, whereby the measurements are represented by a particular pulse frequency that is associated with the respective measurement.

SUMMARY OF THE INVENTION

The invention is based on the aim of supplying a number of measurement sources through the two-wire line and of receiving signals from said sources, whereby the two-wire line should simultaneously be monitored along its entire length as regards its functional capability.

According to the invention, this is done by providing each source of measurements with a pulse generator and by all the pulse generators oscillating above a certain frequency and with a pulse frequency that lies in the same order of magnitude, and by a monitoring shunt being situated at that end of the two-wire line which is away from the central, where said monitoring shunt is constantly switched through in pulse-like fashion by means of a pulse generator, likewise arranged at said end, to generate monitoring pulses, where the pulse frequency of the latter pulse generator is much lower than that of the pulse generators that are situated in the sources of the measurements, whereby the pulse duration of the monitoring pulses is essentially no longer than the pulse pauses of the measurement pulses.

With this circuit arrangement, the pulse generators of the measurement sources and the pulse generator for generating the monitoring pulses are harmonically tuned to one another so that the evaluation of the measurement pulses and the evaluation of the monitoring pulses do not mutually interfere with each other. Furthermore, the circuit arrangement is relatively uncomplicated, since the same principle is used respectively to generate the measurement pulses and to generate the monitoring pulses, namely switching-through a shunt to the two-wire line. The pulse generators which generate the measurement pulses here oscillate above a certain frequency and at a pulse frequency that lies in the same order of magnitude. By contrast, the pulse frequency of the monitoring pulses is significantly lower. As a result, the two pulse frequencies are separable, a feature which is additionally enhanced by the fact that the pulse duration of the monitoring pulses essentially is no longer than the pulse pauses of the measurement pulses. As a result, a large number of measurement pulse will in every case fall within the pulse pauses of the monitoring pulses, in the event that measurement pulses are present.

If such measurement pulses are present, they will represent the dominating signal, which can be detected very readily. Here, the additional occurrence of monitoring pulses or the absence of monitoring pulses does not disturb the delivery of the measurements. This is especially important in the case of fire alarm systems because, in the event of a fire, the fire alarm indication has priority with respect to a defect on the double line. However, if a detect does exist, for example a line rupture, which suppresses delivery of a measurements, this is in any case indicated by the absence of the monitoring pulses, so that an indication occurs even in this case.

The coordination of the measurement pulses and monitoring pulses, as described above, can be advantageously used to detect these pulses separately. This is done as follows: In the central, an RC element for the measurement pulses and an RC element for the monitoring pulses are connected to the two-wire line. Here, the voltage at the capacitor of the former RC element is kept below a threshold by means of a pulse-like discharge that occurs through the monitoring pulses. When this threshold is exceeded, the absence of the monitoring pulses is indicated. The voltage at the capacitor of the latter RC element is raised above a threshold through a charge-up process that occurs by means of the measurement pulses. When this threshold is exceeded, the presence of a measurement is indicated.

The pulse frequencies are therefore separated solely by means of RC elements and threshold switches which respond when monitoring pulses remain absent and/or when measurement pulses appear, and which thus respectively cause the desired message. Only in the case when monitoring pulses remain absent and measurement pulses occur, will the message announce the presence of measurement pulses, because this signal has priority.

The circuit arrangement furthermore can be designed so that it delivers a special signal in the event that measurement pulses are delivered by two measurement sources. This is especially desirable in fire alarm systems for the purpose of avoiding false alarms.

The circuit arrangement can be advantageously designed for this purpose, so that a threshold switch is connected to the two-wire line in the central. This threshold switch responds when two pulses coincide, by forming the summation pulses. It then activates an alarm circuit through a timing element, which triggers the alarm circuit only when the summation pulses that have been formed from measurement pulses directly follow one another.

Since the pulse frequencies of the measurement pulses are of the same order of magnitude, superpositions will occur when measurement pulses are emitted by two measurement sources. In the course of these superpositions, individual pulses will add, which can cause the respective threshold switch to trigger. To prevent the presence of monitoring pulses and measurement pulses from simulating a summation of measurement pulses, where such a summation likewise could be caused over longer time intervals, the abovementioned timing element has been provided, which triggers the alarm circuit only when summation pulses formed from measurement pulses immediately follow one another.

If the measurement pulses are formed by spike pulses, and if two measurement sources are emitting measurement pulses on the two-wire line, the result practically is a pulse train of twice the pulse frequency, which likewise can be used to trigger an alarm. For this purpose, a third RC element is connected to the two-wire line in the central. Here, the voltage at the capacitor of this RC element is raised above a threshold through a charge-up process that occurs by means of the measurement pulses at twice the frequency. When this threshold is exceeded, it indicates the presence of at least two measurements, each delivered by a measurement source. With this circuit, therefore, the same principle can be used advantageously for the evaluation and for the above-mentioned individual evaluation of measurement pulses and/or of monitoring pulses, a feature which adds to the simplicity of the circuit.

DESCRIPTION OF THE DRAWINGS

The figures show embodiments of the invention. The following are shown.

DETAILED DESCRIPTION

Figure 1:
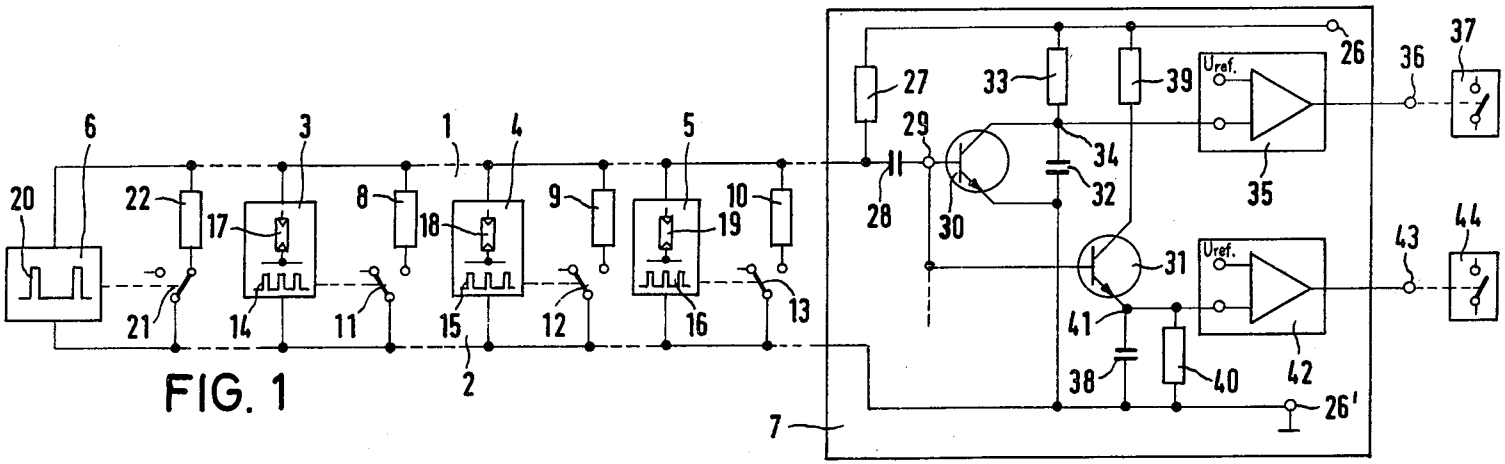
FIG. 1 shows a circuit arrangement comprising: three measurement sources; the pulse generator for generating the monitoring pulses, arranged at the end of the two-wire line; and the central for detecting the monitoring pulses and the measurement pulses.

FIG. 1 shows a two-wire line with the two strands 1 and 2, which extends over the measurement sources that are designed as fire alarms 3, 4, and 5. The fire alarms 3, 4, and 5 here form shunts to the two-wire line ½. Between the individual fire alarms 3, 4, and 5, the two-wire line ½ is drawn in dashes, to indicate that a larger number of fire alarms can also be connected to the two-wire line ½. The monitoring shunt 6 lies at the end of the two-wire line. This monitoring shunt 6 emits monitoring pulses to signal the central 7 that the two-wire line ½ functions properly all the way through.

The fire alarms 3, 4, and 5 are formed by measurement shunt circuits, in which a resistor 8, 9 and 10 respectively is always placed in parallel to the two-wire line ½, in pulse-like fashion, by means of the contacts 11, 12, and 13. The contacts 11, 12, and 13 can involve any type of contact, and especially electronic contacts. The contacts 11, 12 and 13 are controlled by means of the pulse generators 14, 15 and 16, which on their part are controlled by the sensors 17, 18, and 19. In the case of the fire alarm system shown here, the sensors 17, 18, and 19 set the associated pulse generators 14, 15, and 16 into operation when the sensors detect a fire, e.g. by the evolution of smoke. In this case, the contacts 11, 12, and 13 are activated in pulse-like fashion and thereby cause the idle current flowing through the two-wire line ½ to be increased in pulse-like fashion. This idle current is essentially determined by the current consumption of the sensors 17, 18, and 19, which lie in a parallel circuit to the two-wire line ½. The current consumption of the monitoring shunt circuit 6 must also be added to this.

The monitoring shunt circuit 6 contains the pulse generator 20, which controls the contact 21 in pulse-like fashion. The contact 21 connects the resistor 22 to the two-wire line ½.

As long as the two-wire line ½ has no interrupt, the pulse generator 20 of the monitoring shunt circuit 6 receives current and therefore activates the contact 21 continuously in pulse-like fashion.

Figure 2:
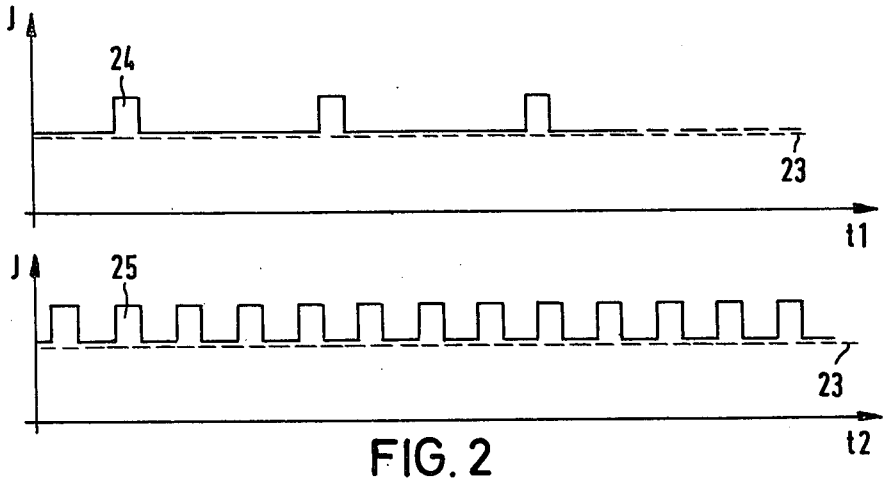
FIG. 2 shows the associated pulse diagram.

The associated pulse diagram is shown in FIG. 2. The idle current 23 is here shown by a dashed line above the time axis t1. The monitoring pulses 24, generated by means of the contact 21, are raised above this idle current 23. In this connection, it should also be pointed out that the contact 21, like the contacts 11, 12, and 13, naturally can be designed in arbitrary fashion, and in particular as an electronic contact. From FIG. 2 it is clear that, in any case, the pulse pauses between the pulses 24 are significantly longer than the respective pulse duration.

When one of the sensors 17, 18, or 19 now responds, the associated contact 11, 12 or 13 respectively is now activated in pulse-like fashion, as explained above, and thus one of the resistors 8, 9 or 10 respectively is connected to the double line ½. In addition to the monitoring pulses 24, one now has the measurement pulses 25, which are shown over the time axis t2 according to FIG. 2. The frequency of these measurement pulses 25 lies above a certain frequency, for example 2 Hz. The pulse frequencies of the pulse generators 14, 15, and 16 of the measurement sources 3, 4, and 5 all are of the same order of magnitude, for example around 5 Hz. A pulse frequency that is much lower than this is then chosen as the pulse frequence of the pulse generator 20, for example a frequency around 0.5 Hz.

Because of this dimensioning of the above-mentioned pulse generators and because of the above-mentioned adjustment of their pulse frequencies with respect to one another, a technically especially favorable possibility for evaluating the pulse frequency appears in the central 7. Through the central 7, a DC voltage from the voltage source 26 and 26' is applied to the two-wire line ½. Here, terminal 26' is grounded. This voltage is applied to the strand 1 through the low-ohm resistor 27, so that, in the idle state, an idle current flows through the two-wire line ½. This idle current is represented by the dashed line 23 in FIG. 2. If monitoring pulses 24 and/or measurement pulses 25 now occur on the double line ½, they will be filtered by the capacitor 28. Consequently, at the point 29, only a pulse voltage without a DC component will remain. Let it now be first assumed that the double line ½ functions properly and only the pulse generator 20 is operating, so that the monitoring pulses 24 are flowing over the double line ½. These will then appear as a pure pulse voltage at the point 29. This pulse voltage is conducted both to the transistor 30 and to the transistor 31. In collaboration with transistor 30, the monitoring pulses 24 have the following effect: The capacitor 32 is connected in parallel with the transistor 30. Said capacitor is constantly being charged from the voltage source 26/26' through the dropping resistor 33. However, the capacitor 32 is discharged through the transistor 30, when the latter receives a pulse at its control electrode. The time constant given by the dropping resistor 33 and the capacitor 32 is now chosen so that the capacitor 32 is always discharged in pulse-like fashion when a monitoring pulse 24 appears, so that the voltage at the terminal 34 of the capacitor 32 is always kept below a certain threshold. This threshold is monitored by the threshold switch 35. When the threshold is exceeded, said threshold switch 35 emits a signal which appears at the output 36 and thus activates the signal generator 37. The threshold will be exceeded when the capacitor 32 is correspondingly charged up. This will happen when the monitoring shunt circuit 6 is put out of operation because of an interruption on the double line ½, so that the monitoring pulses 24 on the double line ½ vanish. The pulse-like discharge of the capacitor 32 then no longer occurs so that the signal generator 34 is activated and consequently an indication is given that a line break exists on the double line ½.

As can be seen from FIG. 1, the pulses appearing at the circuit point 29 are also conducted to the transistor 31. This transistor is connected ahead of the capacitor 38. Consequently, when the transistor 31 becomes transmitting, the capacitor 38 is charged up from the voltage source 26/26' through the resistor 39. The resistor 40 is connected in parallel to the capacitor 38, so that the capacitor 38 can discharge again and again through the resistor 40. The discharge time constant given by the capacitor 38 and the resistor 40 now is chosen so that the monitoring pulses 24, which appear at the circuit point 29, and which switch-through the transistor 31 in pulse-like fashion corresponding to their pulse frequency, can cause the capacitor 38 to be charged up only relatively little, since, during the relatively long pauses between the monitoring pulses 24, the capacitor 38 can again and again largely discharge through the resistor 40. The threshold switch 42 is connected to one terminal 41 of the capacitor 38. When a particular threshold is exceeded, this threshold switch 42 will respond and, through the output terminal 43, it will thus activate the signal generator 44 which is connected to said terminal. However, when only the monitoring pulses 24 are applied to the transistor 31, this threshold is not reached because, on the basis of these pulses, the capacitor 38, as explained above, cannot charge up sufficiently. However, if one of the sensors 17, 18, or 19 is excited, measurement pulses 25 are emitted over the double line ½ in the manner described above. The capacitor 28 filters out their DC component, and they thus appear at the circuit point 29 and are conducted to the transistor 31. Because of the relatively high frequency of the measuring pulses 25, and because the transistor 1 now switches through in pulse-like fashion, the capacitor 38 is charged up step-by-step. In this case, it can discharge only a little during the pauses between the measurement pulses 25, so that the respectively following measurement pulse charges up the capacitor 38 until its full charge voltage is reached. The threshold that is being monitored by the threshold switch 42 will now be exceeded, so that the threshold switch 42 is activated and thus causes the signal generator 44 to emit a signal. This signal now represents the actual fire alarm.

To generate this alarm, it does not matter whether or not the monitoring shunt circuit 6 has simultaneously caused the emission of monitoring pulses 24. Naturally, the absence of monitoring pulses 24 with the simultaneous emission of measurement pulses 25 is possible only when a line break signaled by the absence of the monitoring pulses 24 is situated behind that particular measurement shunt circuit 3, 4, or 5 which has initiated a fire alarm. Normally, the emission of measurement pulses 25 will occur together with the emission of monitoring pulses 24. However, this does not disturb evaluation through the transistor 31 since the capacitor 38 will be charged up in any case when the measurement pulses 25 appear.

The circuit arrangement shown in FIG. 1 can also be expanded in such a way that it generates a special signal when more than one measurement source emits measurement pulses. This case is important for signaling a fire alarm inasmuch as several sensors will respond in every case when a fire actually occurs and when the sensors are adequately distributed. If this is presupposed, the possibility exists of waiting after a sensor has emitted an alarm until at least a second sensor also emits an alarm. All alarms that are emitted by only one sensor are then excluded, since they are most probably based on improper activation. This is especially important when an automatic extinguishing system may be triggered in case of a fire alarm.

Figure 3:
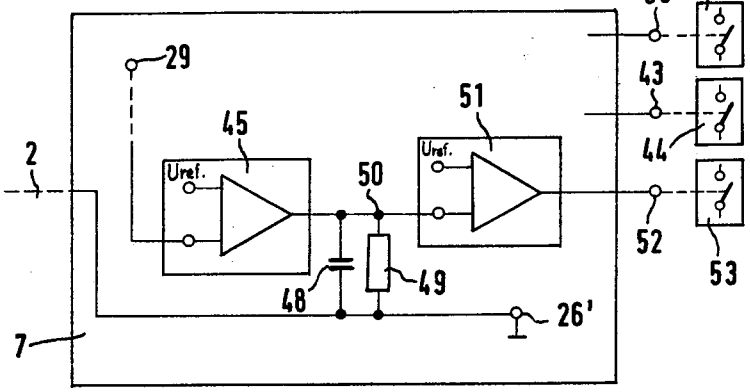
FIG. 3 shows a supplement to the circuit arrangement in accord with FIG. 1 to detect the emission of measurement pulses from two measurement sources. Here, summation pulses are evaluated.
Figure 4:
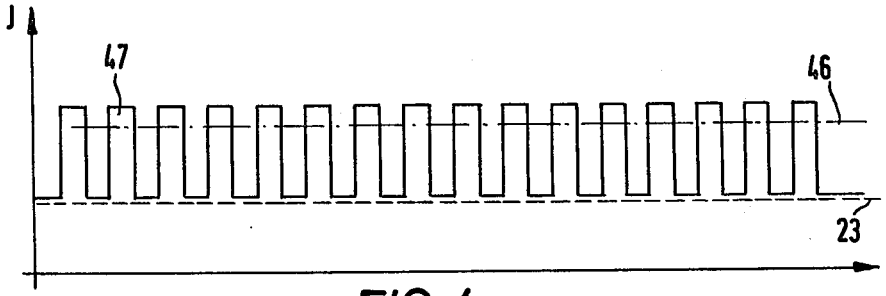
FIG. 4 shows the associated pulse diagram.

FIG. 3 shows an extension of the central according to FIG. 1. In accord with this extension, the threshold switch 45 is also connected to the circuit point 29. This threshold switch 45 is activated when monitoring pulses 25 are delivered by two measurement shunt circuit 3, 4, and 5 respectively. In this case, because of the approximately equal frequency of the measurement pulses 25, a summation occurs at least some of the time in the form of summation pulses, which are shown in the pulse diagram according to FIG. 4. These summation pulses occur at the circuit point 29 and are raised above the idle current 23. The threshold of the threshold switch 45 is shown in FIG. 4 by the dot-and-dash line 46. As can be seen, the peaks of the summation pulses 47 exceed the threshold 46, whereupon the threshold switch 45 is triggered and causes the capacitor 48, connected in series with it, to charge up. The resistor 49 is connected in parallel with the capacitor 48, so that the capacitor 48 is discharged again and again. The discharge time constant is here chosen so that the capacitor 48 can be adequately charged up only with an immediate succession of the summation pulses 47, which are formed from the measurement pulses 25, as is shown in FIG. 4. The RC element consisting of the capacitor 48 and the resistor 49 therefore forms a timing element. At its circuit point 50, it allows a certain voltage to be generated only when successive summation pulses 47 are signaled by the threshold switch 45. On the other hand, if such summation pulses occur only sporadically, for example by the coincidence of a measurement pulse 25 and a monitoring pulse 24, this summation pulse will not be sufficient to generate a sufficiently high voltage at the circuit point 50. The voltage at the circuit point 50 now is decisive for the subsequent threshold switch 51. Said threshold switch 51 responds only when the switching point 50 has a voltage that has been generated by successive summation pulses 47. In that case, it activates the signal generator 53 through the output terminal 52. The signal generator 53 indicates that a fire alarm has been reported by two sensors 17, 18 or 19 respectively. The remaining functioning of the elements of the central 7, as described above, is not impaired thereby.

Figure 5:
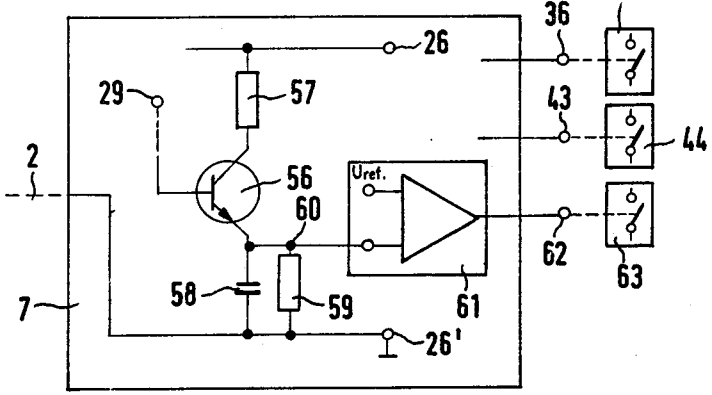
FIG. 5 shows another embodiment of a supplement to the circuit arrangement according to FIG. 1, for detecting the presence of measurement pulses delivered by two measurement sources, where the measurement pulses are formed by spike pulses.
Figure 6:
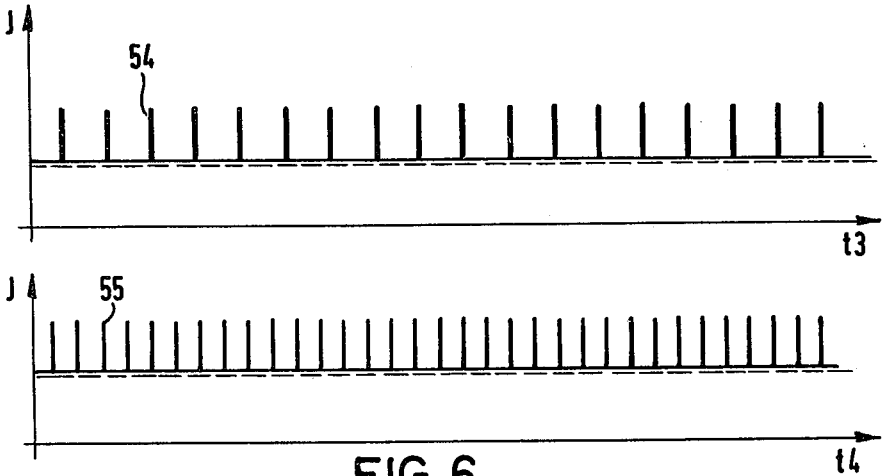
FIG. 6 shows the associated pulse diagram.

FIG. 5 shows another embodiment for detecting such a multiple alarm. Here, it is presupposed that at least the measurement pulse are present as spike pulses 54, as shown in the pulse diagram according to FIG. 6 along the time axis t3. Now, if two sensor 17, 18 or 19 respectively are activated, this will lead to measurement pulses 55 of twice the frequency, as drawn in FIG. 6 over the time axis t4. Since the pulse frequency of these pulse generators is not the same, a pulse pattern according to FIG. 6 must result at least from time to time. This pulse pattern corresponds to the above-mentioned double pulse frequency of the measurement pulses 55. This effect is now used in a circuit according to FIG. 5, which represents a supplement to the central according to FIG. 1. Accordingly, the transistor 56 is additionally connected to the circuit point 29. Through the resistor 57, the transistor 56 conducts the supply voltage available at terminal 26 to the capacitor 58. The capacitor 58 is connected in parallel with the resistor 59. The discharge time constant of the capacitor 58 and the resistor 59 now is chosen so that, when the measurement pulses 54 appear, the capacitor 58 does indeed receive charges in pulse-like fashion, but its charge can again and again dissipate through the resistor 59, so that only a relatively low voltage can arise at the circuit point 60. However, if measurement pulses from two sensors 17, 18 or 19, that is the measurement pulses 55 according to FIG. 6, now appear at the two-wire line ½, the voltage at the circuit point 60 will now increase because of the doubling of the pulse frequency, and this increase will be of such magnitude that the subsequent threshold switch 61 responds and activates the signal generator 63 via the output terminal 62. The signal generator 63 will thus signal an indication that two sensors have triggered a fire alarm. In the case of this circuit also, when the circuit responds the functions of the other elements of the central 7 according to FIG. 1 are unaffected.

While various aspects of the invention have been set forth by the drawings and specification, it is to be understood that the foregoing detailed description is for illustration only and that various changes in parts as well as the substitution of equivalent constituents for those shown and described may be made without departing from the spirit and scope of the invention as set forth in the appended claims.

What is claimed is:

1. Apparatus for the transmission of alarm signals to a detector, comprising a signaling channel, means for energizing said signaling channel, means for applying monitoring signals to said channel at a first frequency, means for applying alarm signals to said channel at a second frequency greater than that of said first frequency, and means connected to said channel for detecting the monitoring and alarm signals, wherein the duration of said monitoring signals is no longer than the interval between said alarm signals.

2. Apparatus as defined in claim 1 for transmitting fire alarm signals to a central detector, wherein said signaling channel is a two-wire line, the energizing means is a supply voltage applied to said two-wire line, the monitoring signal means is connected in shunt with said two-wire line, and the alarm signaling means comprises a plurality of measurement sources connected in shunt with said two-wire line.

3. Apparatus as defined in claim 2 wherein said alarm signaling means generates measurement pulses and said monitoring signal means generates monitoring pulses.

4. Apparatus as defined in claim 2 wherein said central detector includes a resistance-capacitive charging circuit connected to said two-wire line for detecting said monitoring signals and a separate resistance-capacitance charging circuit connected to said two-wire line for detecting said alarm signals, the first resistance-capacitance charging circuit being proportioned to keep the voltage on the capacitor below a prescribed threshold during the occurrence of said monitoring pulses and the second resistance-capacitance charging circuit is proportioned to indicate the occurrence of said measurement pulses.

5. Apparatus as defined in claim 4 wherein said detector further includes a threshold switch connected to said two-wire line and said threshold switch activates an alarm only for the coincidence of two measurement pulses.

6. Apparatus as defined in claim 3 wherein said measurement pulses are generated as impulses and said central detector includes a resistance-capacitance charging circuit for detecting the occurrence of a plurality of measurement impulses.

7. Apparatus as defined in claim 6 wherein said central detector includes further resistance-capacitance charging circuits for the measurement of monitoring pulses having greater pulse widths than said impulses.

8. Apparatus as defined in claim 1 wherein said detector includes separate resistance-capacitance charging circuits for the measurement of the respective monitoring and alarm signals.

* * * * *